United States Patent [19]

Petrou

[11] Patent Number: 4,997,114

[45] Date of Patent: Mar. 5, 1991

[54] HANGER WITH INDICIA TAB

[76] Inventor: Nicoleon Petrou, 1531 W. Tedmar, Anaheim, Calif. 92802

[21] Appl. No.: 379,413

[22] Filed: Jul. 13, 1989

[51] Int. Cl.[5] ..... G09F 3/00; A47G 25/14

[52] U.S. Cl. ..... 223/85; 40/322; 223/88; 223/92

[58] Field of Search ..... 40/322; 223/85, 86, 223/88, 92, 95

[56] References Cited

U.S. PATENT DOCUMENTS

| | | | |
|---|---|---|---|
| 1,348,952 | 2/1920 | Landry | 40/322 |
| 1,389,266 | 8/1921 | Newton | 40/322 |
| 1,575,775 | 3/1926 | Lesser | 40/322 |
| 3,949,914 | 4/1976 | Ostroll | 223/85 |
| 4,006,547 | 2/1977 | Samuels | 40/322 |
| 4,017,990 | 4/1977 | Garrison | 40/322 |
| 4,115,940 | 9/1978 | Phillips | 40/322 |

*Primary Examiner*—Werner H. Schroeder
*Assistant Examiner*—Bibhu Mohanty
*Attorney, Agent, or Firm*—Blakely, Sokoloff Taylor, Zafman

[57] ABSTRACT

An apparatus for hanging garments and exhibiting garment indicia is disclosed. The apparatus has a body for hanging garments therefrom and a hook. The apparatus also contains an attachment for a garment indicia tab, which is used for displaying information regarding the associated garment. The indicia carrying tab has a body and legs and is removable and interchangeable as desired.

1 Claim, 2 Drawing Sheets

FIG. 1
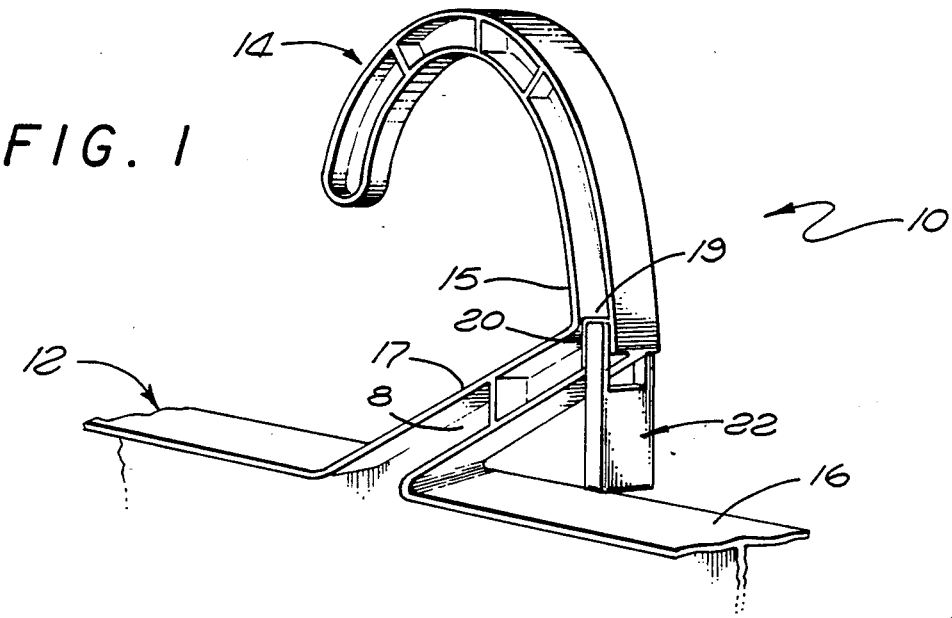
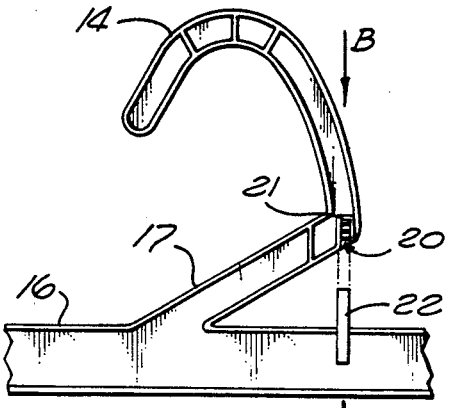
FIG. 2
FIG. 3
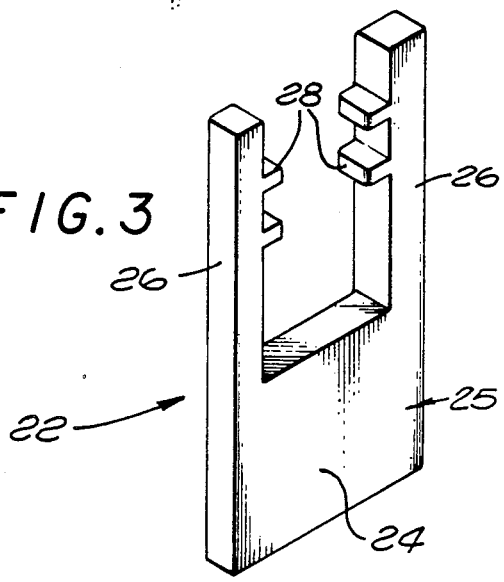
FIG. 4
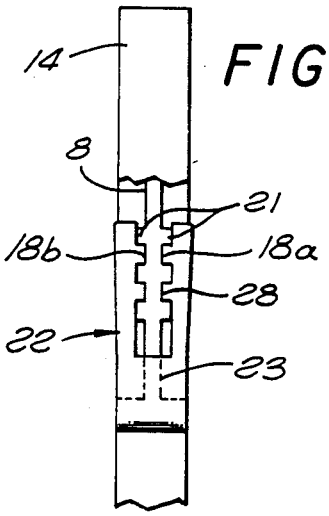
FIG. 5
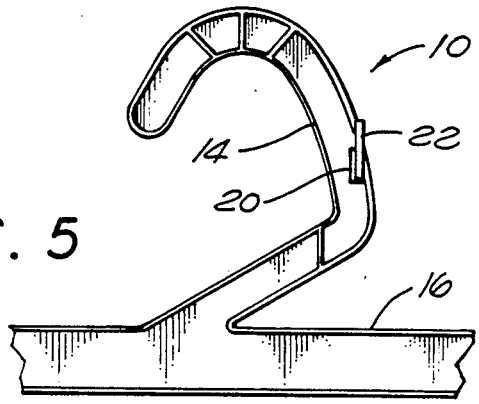

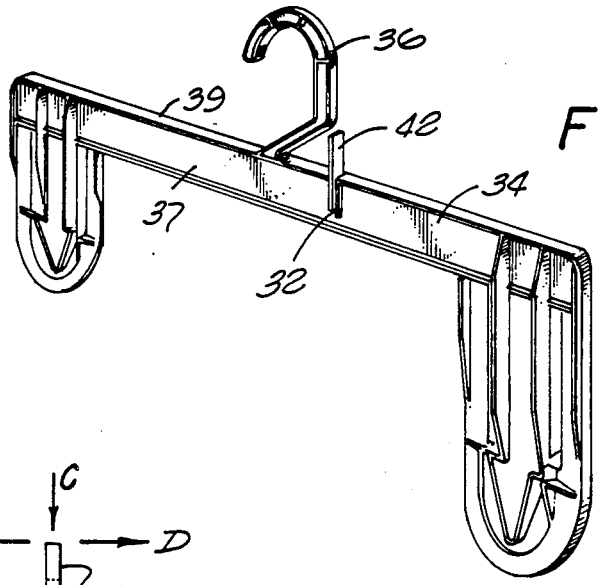
FIG. 6
FIG. 7
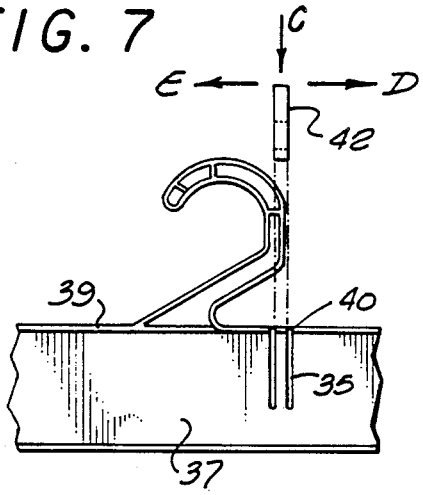
FIG. 8
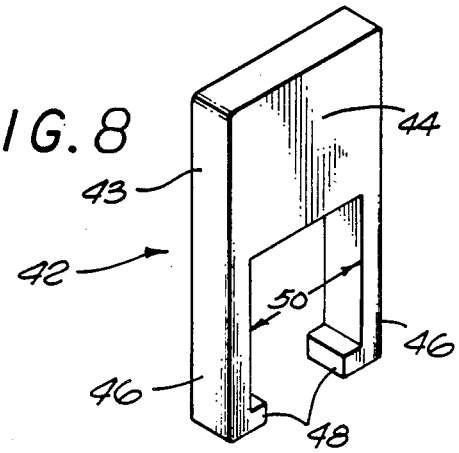
FIG. 9
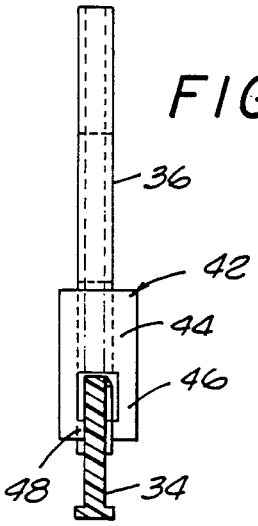
FIG. 10
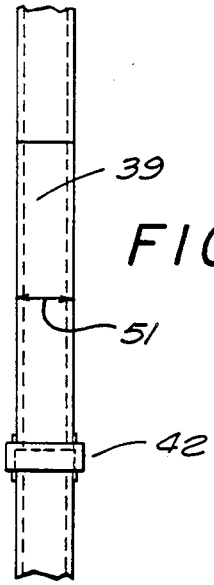

HANGER WITH INDICIA TAB

BACKGROUND OF THE INVENTION

1. Field of the Invention

The present invention relates to garment hangers and more particularly to an apparatus for hanging garments and exhibiting garment indicia.

2. History of the Prior Art

Prior designs of identification devices for garment hangers include stationary indicia means. The device disclosed in U.S. Pat. No. 3,949,914 features a marker device with four clasping members that is attachable to a portion of the hanger's hook. That design utilizes a very elaborate marking device construction. It also limits attachment of the marking device to the hook portion of the hanger.

Removable carrying indicia means disclosed in U.S. Pat. No. 4,006,547 require means for deep mountings in the body of the hanger to facilitate proper attachment. Therefore, these means are not acceptable for a hanger constructed of thin resilient material. Moreover, this design doesn't allow the mountings to be located on the hook of the hanger.

U.S. Pat. No. 4,115,940 discloses a design that requires an imposing tab mounting member to be molded to the body of the hanger. This design is inefficient, since it requires a substantial amount of material to form support means for the indicia. In addition, the design permanently alters the shape and overall form of the hanger.

The indicia display means that are presently available do not exhibit the efficiency standard desired to eliminate the waste of material used in creation of garment hangers. Also, the prior designs do not allow the flexibility of attaching the indicia carrying means on any part of the hanger hook or body which is desired.

SUMMARY OF THE INVENTION

Generally, an improved hanger is provided with a removable indicia carrying tab used for indicating size, type or other pertinent information regarding the corresponding garment. The body of the hanger carries means for releasably attaching the indicia carrying tab located preferably on the straight portion of a hook, just below the junction of the straight and curved portions of the hook. In another embodiment, the means for attaching the indicia carrying tab are located preferably on the body of the hanger below the straight portion of the hook.

In the preferred embodiment, the means for attaching the indicia carrying tab are formed by the raised exterior border of the hook. Although, for the most part, the raised exterior border extends along the outer edge of hook body, it turns inward the hook body at the preferred location of attachment of the indicia carrying tab. The raised exterior border forms a rectangular receptacle for the indicia carrying tab on the hook body. The receptacle has an opening for the insertion of the indicia carrying tab. The opening of the receptacle is directed downward, in the direction of the hanger body. The inside part of the receptacle contains a plurality of support teeth which are used for securing the indicia carrying tab against accidental detachment.

The indicia carrying tab is attached to the hook by means of coupling teeth on the leg members of the indicia carrying tab. The attachment is realized by inserting the indicia carrying tab inside the receptacle so that the leg members of the indicia carrying tab spread around the walls of the hook. After the indicia carrying tab is completely inserted, the support teeth inside the receptacle lock with the coupling teeth of the indicia carrying tab and thus prevent against accidental detachment. Similarly, the raised exterior border prevents lateral movement of the tab.

In another embodiment, the means for attaching the indicia carrying tab consist of two pairs of support ribs molded to the body of the hanger. The indicia carrying tab is attached to the body by means of a pair of clasping leg members, where each of the clasping leg members fits in between the corresponding set of the support ribs. After the indicia carrying tab is completely inserted, the support ribs prevent its lateral movement.

The preferred attachment means can be located anywhere along the body of the hanger. For example, another embodiment illustrates the attachment receptacle located on another portion of the hook, and the opening of the receptacle pointing away from the hanger body (See FIG. 5). Accordingly, the present invention provides the ability to produce custom alternatives of garment hangers that are better suited to consumer needs.

The use of the raised exterior border and the support teeth as attachment means for the indicia carrying tab obviates the need for extra material, normally used for hanger assembly, for realization of the desired attachment. Since hangers are manufactured in large quantities, the reduction of needed material will bring down the costs to the manufacturers and the consumers.

Another advantage of the preferred embodiment of the present invention is that it enables use of indicia carrying tabs having a width no greater than the width of the hanger. This is achieved by the utilization of the exterior border of the hanger body to support the tab, thereby enabling the tab to engage the relatively thin planar wall of the hanger. The combination of hangers with tabs which do not extend beyond the edges of the hangers enables a greater number of hangers to be shipped. In addition, less material is required to product the indicia carrying tabs, thereby resulting in a cost savings.

Accordingly, it is an object of this invention to provide an improved garment hanger with a detachable indicia carrying tab which is clearly visible to prospective consumers.

Another object of this invention is to provide an improved garment hanger with a detachable indicia carrying tab which minimizes the amount of material normally used for hanger assembly.

A further object of this invention is to provide an improved garment hanger with a detachable indicia carrying tab which is readily removable yet is secure against accidental detachment.

Still another object of this invention is to provide an improved garment hanger with a detachable indicia carrying tab where the attachment means for the indicia carrying tab can be realized anywhere along the hanger body or hook.

Still other objects and advantages of the invention will be further understood and described in the detailed description of the preferred embodiments set forth below.

BRIEF DESCRIPTION OF THE DRAWINGS

FIG. 1 is a partial perspective view illustrating the preferred cooperation between the garment hanger and the indicia carrying tab.

FIG. 2 is a partial side view with the indicia carrying tab disengaged from the receptacle.

FIG. 3 is a detailed perspective view of the indicia carrying tab.

FIG. 4 is a partially cut away sectional view taken along line 4—4 of FIG. 2, with indicia carrying tab being shown attached.

FIG. 5 is a partial side view illustrating another embodiment of the invention.

FIG. 6 is a perspective view illustrating the third embodiment with the indicia carrying tab attached.

FIG. 7 is a partial side view illustrating the third embodiment with the indicia carrying tab disengaged from a receptacle.

FIG. 8 is a perspective view of the indicia carrying tab corresponding to the third embodiment.

FIG. 9 is a front sectional view of the third embodiment with the indicia carrying tab attached.

FIG. 10 is a top view of the third embodiment with the indicia carrying tab attached.

DETAILED DESCRIPTION OF THE PREFERRED EMBODIMENT

FIGS. 1–4 illustrate a first embodiment of the apparatus 10 of the present invention. The apparatus 10 includes hanger body 12 and a hanger hook 14 extending therefrom. Both the hanger body 12 and the hanger hook 14 have an raised exterior border 16 extending about their peripheries.

The attachment means for the indicia carrying means are formed by the raised exterior border 16 of the hanger hook 14. The raised exterior border 16 turns inward the hook body 15 on a straight portion 17 of the hook 14 right below the junction 19 of the straight and curved portions of the hook 14. The raised exterior border 16 forms a rectangular receptacle 20 on the hook body 15 for the indicia carrying tab 22. The receptacle 20 includes a centrally disposed partition 23 forming a first basin 18*a* and a second basin 18*b* on a second, opposing side thereof. The basis 18*a*, 18*b* each support a set of support teeth 21 extending from the surface thereof. Support teeth 21 are used for securing the indicia carrying tab 22 within the receptacle 20, as will be discussed below.

The indicia carrying tab 22 is made out of resilient material, preferably plastic. The indicia carrying tab 22 comprises a main portion 23 with a rectangular display face 24 upon which the information about an associated garment may be displayed. Two leg members or enlarging means 26 extend from the main portion 23. A set of securing means or coupling teeth 28 extend in a transverse direction from an inner surface of each leg 26. The indicia carrying tab 22 may be of unitary construction or the leg members 26 may be molded separately and subsequently attached to the main portion 23 by a suitable adhesive.

The indicia carrying tab 22 is secured to the hanger 10 by inserting it into the receptacle 20 in Direction A (as shown in FIG. 2). As the indicia carrying tab 22 is inserted, the coupling teeth 28 of the tab 22 become engaged between the support teeth 21 of the receptacle 20. The interlocking engagement of the support teeth 21 and the coupling teeth 28 prevents downward movement of the indicia carrying tab 22 relative to the receptacle 20, as can be readily seen in FIG. 4. The part of raised exterior border 16 forming the receptacle 20 provides lateral support for the indicia carrying tab 22.

The width of the indicia carrying tab 22 is no greater than the width of the exterior border 16. This is achieved by the utilization of exterior border 16 for support of the tab 22, thereby enabling tab 22 to engage the relatively thin planar wall 8 of hook 14. Accordingly, tab 22 is narrow and is less expensive to produce, thus enabling the maximum number of hangers to be stored and shipped.

The indicia carrying tab 22 is easily removed from the receptacle 20, by pulling it in Direction B (as shown in FIG. 2). Since the support teeth 21 and the coupling teeth 28 are interlocked when the indicia carrying tab 22 is attached, the indicia carrying tab 22 will initially provide some resistance. However, since it is constructed of resilient material, the indicia carrying tab 22 will then easily dislodge from the receptacle 20.

FIG. 5 illustrates a second embodiment of the present invention in which the garment hanger 10 includes a receptacle which is located on a different portion of the hanger hook 14 so that the tab 22 extends generally vertically when in place.

In yet another embodiment, shown in FIGS. 6–10, the receptacle 32 for the indicia carrying tab 42 is located on the hanger body 34 below the straight portion of hook 36. The receptacle 32 consists of two sets of support ribs 35, where each set is molded to the wall 37 of the hanger body 34. Each set of support ribs 35 runs transverse to raised exterior border of the hanger body 34 with the top end 40 of each support rib 35 molded into raised exterior border 39.

FIG. 8 illustrates indicia carrying tab 42 for this embodiment. As in the previous embodiments, the indicia carrying tab 42 comprises a U-shaped structure. A main portion 43 has a rectangular face 44. Two leg members 46 extend from main portion 43. Each leg 46 terminates with an inwardly extending safety knob 48. The length of the leg members 46 is generally equal to the length of support ribs 35. The distance 50 between the leg members 46 is equal to the width 51 of raised exterior border 39.

The indicia carrying tab 42 is inserted onto the hanger body 34 in the direction C, as shown in FIG. 7. As the indicia carrying tab 42 is inserted, the leg members 46 will spread slightly apart because, as noted above, distance 50 between the leg members 46 is generally equal to the width 51 of the raised exterior border 39. However, after the indicia carrying tab 42 is completely inserted, the resiliency of safety knobs 48 and support ribs 35 will insure its stable position. If the hanger 10 is turned upside down, safety knobs 48 will prevent displacement of the indicia carrying tab 42, because they will hook on the raised exterior border 39. Similarly, support ribs 35 will prevent the movement in directions D and E, as shown in FIG. 7.

The indicia carrying tab 42 also allows for easy intentional removal and replacement. Since the indicia carrying tab 42 is made out of resilient material, it is removed by slightly bending one of leg members 46 and pushing on the indicia carrying tab 42 in any direction.

The indicia carrying tabs 22 or 42 can be used for providing information on the size, price or other pertinent data about the garment. The mentioned information may be located on both or either sides of main portions 23 or 43, so that the person attaching the tabs to the hangers does not need to spend time figuring out which way the tab should be attached for clear visibility.

It should be understood that the present invention may include use of any type, size or style of garment hanger. It should also be understood that all matter contained in the above description shall be interpreted as illustrative and not in a limiting sense. It should also be understood that the following claims are intended to cover all of the generic and specific features of the invention and all statements of the scope of the invention which, as a matter of the language, might be said to fall therebetween.

What is claimed is:

1. An apparatus for hanging garments and exhibiting garment indicia, comprising:

a garment hanger having a body for hanging garments therefrom and a hook extending from said body;

an indicia receptacle formed within said garment hanger, said indicia receptacle including an exterior raised border portion and including a partition forming a first basin on one side thereof and a second basin on a second opposing side thereof, the peripheries of said basin being defined by said raised borders and further including at least one supporting tooth extending from each side thereof, and an indicia-carrying tab, including engaging means for cooperating with said indicia receptacle in the exterior border thereon to removeably connect said indicia-carrying tab to said body, said engaging means comprising a pair of opposed leg members being sufficient spaced apart in construction with sufficient flexibility such that the leg members can be fitted over said raised border into recessed portions of said indicia receptacle, said leg members including securing means for supporting said leg members within said recessed portion, said securing means comprising at least one coupling tooth extending from an inner surface of each leg member, said at least one coupling tooth being constructed so as to fit within said indicia receptacle and engage said at least one supporting tooth of said indicia receptacle in an associated basis, said indicia-carrying tab having at least one display face thereof for exhibiting garment indicia.

* * * * *